US006670034B2

(12) United States Patent
Boyd et al.

(10) Patent No.: US 6,670,034 B2
(45) Date of Patent: Dec. 30, 2003

(54) SINGLE INGREDIENT, MULTI-STRUCTURAL FILAMENTS

(75) Inventors: Chad Boyd, Lexington, SC (US); Peter Brissette, Blythewood, SC (US); Atiye E. Tanverdi, Columbia, SC (US)

(73) Assignee: Shakespeare Company, LLC, Columbia, SC (US)

( * ) Notice: Subject to any disclaimer, the term of this patent is extended or adjusted under 35 U.S.C. 154(b) by 0 days.

(21) Appl. No.: 10/099,614

(22) Filed: Mar. 14, 2002

(65) Prior Publication Data

US 2003/0157322 A1 Aug. 21, 2003

Related U.S. Application Data

(60) Provisional application No. 60/330,318, filed on Oct. 18, 2001.

(51) Int. Cl.[7] ..... D01F 8/00

(52) U.S. Cl. ..... 428/370; 428/373; 428/374

(58) Field of Search ..... 428/370, 373, 428/374

(56) References Cited

U.S. PATENT DOCUMENTS

| | | | | |
|---|---|---|---|---|
| 3,650,884 A | | 3/1972 | Hansen | 161/175 |
| 4,069,363 A | | 1/1978 | Segraves et al. | 428/224 |
| 4,610,916 A | | 9/1986 | Ballard | 428/224 |
| 5,424,125 A | | 6/1995 | Ballard et al. | 428/364 |
| 5,540,992 A | | 7/1996 | Marcher et al. | 428/373 |
| 5,698,322 A | * | 12/1997 | Tsai et al. | 428/373 |
| 5,948,529 A | | 9/1999 | Hastie | 428/373 |
| 6,207,276 B1 | | 3/2001 | Spindler et al. | 428/373 |
| 6,254,987 B1 | | 7/2001 | Delker | 428/373 |
| 2002/0023356 A1 | | 2/2002 | Skinner et al. | 30/276 |

* cited by examiner

*Primary Examiner*—N. Edwards
(74) *Attorney, Agent, or Firm*—Renner, Kenner, Greive, Bobak, Taylor & Weber

(57) ABSTRACT

A multi-structural filament comprises a single ingredient having two or more morphologies after extrusion through a die pack wherein one discrete region of the filament comprises one morphology of the ingredient and at least another discrete region of the filament comprises another morphology of the same ingredient, and wherein each region of the filament comprises at least about 7 percent of the filament. A process for the production of the filament is also described.

13 Claims, No Drawings

SINGLE INGREDIENT, MULTI-STRUCTURAL FILAMENTS

This application claims the benefit of priority of U.S. Provisional Application Ser. No. 60/330,318, filed Oct. 18, 2001.

BACKGROUND OF THE INVENTION

Production of filaments and fibers have long been known in the art. Typically, these filaments and fibers are produced utilizing well known extrusion techniques. Generally, this includes the use of a single extruder through which a material, such as a polymeric material, is melted and forced through a die head to form the filament.

Filaments which are produced from such single extrusion processes are generally characterized as monofilaments, although the term "monofilament" has also typically referred to any filaments of indefinite or extreme length. Thus, the term "monofilaments" as used in connection with single extrusion processes may be more particularly characterized as "monoconstitutent" or monocomponent" monofilaments, meaning they are extruded from only one polymer and have a homogeneous cross section throughout the entire length of the fiber. For ease of discussion herein, a "monofilament" will refer to this type of fiber made by this single extrusion process. The term "filament" will refer to what is often termed "monofilament".

Since a single extruder is employed, the processing conditions and parameters, e.g., temperature (heat) profile, screw speed, shear, die size, die profile, draw ratio, etc., can be controlled and manipulated in a manner which can affect the overall physical or mechanical properties of the monofilament thus produced, since it is well known that these processing conditions can and do affect the morphology, i.e., the general shape, arrangement and function of the crystalline structure within the polymer, which in turn influence the properties of the monofilament. However, it will be appreciated that the morphology of the entire monofilament will be substantially the same throughout the entire filament. While the processing conditions and parameters can be controlled and manipulated to affect the final physical properties of the monofilament, the monofilament itself has a morphology which is essentially identical throughout.

Accordingly, in order to obtain better results, various blends of polymers or copolymers have been employed to improve certain desired physical properties of the monofilaments, depending upon the desired application. Traditional applications for monofilament lines include weed trimmer line, fishing line, and sewing threads. These monofilaments may also be woven into or otherwise processed into various industrial and commercial fabrics for various applications including fabrics for use as papermachine clothing, hosiery, and hook and loop fasteners. It will be appreciated that a blend of polymers may provide a different morphology to the monofilament than would a single polymer since the blend has at least one different ingredient. Thus, the mechanical properties of the monofilament comprising a blend of polymers will differ from the mechanical properties of a monofilament comprising a single ingredient.

Although monofilaments have provided suitable results in most applications, the limitations of monofilaments to one material (i.e., either one ingredient or a blend of ingredients) having one general overall morphology has created interest in multi-structural filaments. By the term "multi-structural," it is meant that, through the cross section of each filament at any place along the length of the filament, there are two or more discrete regions of extruded components. Multi-structural filaments, as known heretofore, are generally referred to as "multicomponent monofilament" or "composite filaments". These multi-structural filaments are essentially produced by co-extrusion of two or more polymers in such a manner that each polymer occupies a discrete region that runs the length of the filament. When such a filament consists of two discrete materials or polymeric components, the filament is sometimes referred to as a "bicomponent monofilament." The actual shape and size of the discrete regions are predetermined by the extrusion control techniques and die packs employed. Typical multi-structural cross sectional configurations include core-sheath, side-by-side, and islands-in-the-stream configurations. Other, more complex configurations may include core-mantle-sheath configurations, islands-in-the-stream configurations having multiple sized islands or core-sheath configurations where the sheath does not completely surround the core, e.g., core-tips configurations.

Heretofore, multi-structural filaments have been produced as bicomponent or multicomponent filaments utilizing two or more extruders working in tandem to force two or more distinct materials (or distinct blends of materials) through different channels in a common die head so as to produce filaments that contain two or more discrete regions of different materials encompassed in the extruded profiles and determined by way of their respective extruders and die head paths. For instance, to produce a core-sheath bicomponent filament, essentially the same extrusion techniques are utilized as were employed in the production of monofilaments, except that two separate extruders are run in tandem and process two different materials. One extruder is used to melt and force a first ingredient into the die pack which will ultimately produce the core of the filament, while the other extruder is used to melt and force a second, different ingredient into the die pack where it follows a different flow path such that it ultimately produces a sheath around the core in producing the filament.

Because two independently controlled extruders are employed which use two different materials, the characteristics of each of these discrete materials and, therefore, the physical properties within each discrete region of the filament made from one of the materials can be adjusted in a manner which is beneficial to the performance characteristics of the bicomponent filament. For example, suppose one ingredient has excellent abrasion resistance and toughness, but lacks dimensional stability. On the other hand, a second ingredient is not as resistant to abrasion but provides greater dimensional stability. Depending upon the application, it may be beneficial to provide a sheath of the abrasion resistance material around the core component having excellent dimensional stability to provide an improved filament. Thus, it will be appreciated that the use of two extruders and two materials allows for increased versatility of the end product's physical performance through control of the materials used, control of the processing conditions and the orientation or configuration under which the materials are extruded, sent through the die pack and drawn.

Although bicomponent filaments are becoming increasingly popular, there are still limitations to filament production using the bicomponent process. First and foremost is the issue of compatibility of the components or ingredients. In the example above relating to an ingredient with excellent abrasion resistance and low dimensional stability and a second ingredient with improved dimensional stability but lower abrasion resistance, the first ingredient could be viewed as nylon while the second might be polyethylene terephthalate (PET). However, it is well known that nylon and PET are not sufficiently compatible with each other to produce a bicomponent filament using just these two materials. If nylon were to be made into a sheath around a PET core, without some additional adhesive, compatibilizing agent, or compatibilizing layer therebetween, the filament would simply fall apart as the two are not sufficiently compatible for filament production. In fact, it is known that external stresses or other forces may be sufficient to cause delamination of these incompatible materials, notwithstanding the additives used to keep them together.

Consequently, many patentees and users of the bicomponent process employ materials that, while similar and compatible, are different in terms of their chemical structure or are blends or copolymers of other processing materials. For example, U.S. Pat. No. 6,207,276 discloses a core-sheath bicomponent fiber wherein the core is produced from nylon 6 or nylon 6,6, while the sheath is produced from polyamides having a melting point of at least 280° C., such as nylon 4,6, 9T, 10T, 12T, or nylon copolymers 46/4T, 66/6T, and 6T/6I. These latter nylon homopolymers and copolymers, as well as their base monomers, are very different in their morphologies from nylon 6 or nylon 6,6 and their base monomers.

Similarly, U.S. Pat. No. 4,069,363 discloses a bicomponent filament wherein the core is produced as a copolymer of hexamethylene dodecanedioamide (i.e., nylon 6,12) and E-caproamide (i.e., nylon 6), while the sheath is either nylon 6,12, nylon 6,6 or nylon 6 only. Again, the starting materials employed prior to extrusion are not the same and have different chemical structures, morphologies, and physical properties prior to being extruded.

Still other examples of bicomponent processes include U.S. Pat. No. 5,948,529 wherein a bicomponent filament having a core of PET and sheath of polyethylene is disclosed. The PET core also includes a functionalized ethylene copolymer blended therein. Clearly, the morphologies of the core and sheath starting components in this patent differ greatly.

U.S. Pat. No. 6,254,987 discloses a core-sheath bicomponent filament which displays enhanced abrasion resistance. The core is a liquid crystalline polyester and the sheath is a blend of 1 to 5 percent by weight polycarbonate and a polyester. Again, the core and sheath starting materials are different in chemical structure.

Also, U.S. Pat. No. 5,540,992 discloses a bicomponent fiber comprising a high melting core comprising high density polyethylene and a low melting sheath comprising low density polyethylene. Thus, while the fiber contains the class of polymers (i.e., polyethylene) in both the core and the sheath, it does not contain the same ingredient having the same chemical structure and physical morphology. That is, the chemical structure, molecular weight and molecular weight distribution, among other things, are different between the core component and the sheath component prior to extrusion. In other words, low density polyethethylene and high density polyethylene, while having similar chemical composition, are quite different in morphology and topology.

Thus, heretofore, the prior art has not envisioned using the same ingredient for producing all structural parts or discrete regions of a multi-structural filament. Unexpectedly, it has been discovered that by controlling the extrusion process control profiles and the shear rate of the ingredients as they are processed, different morphologies of the same ingredients can be produced to provide structural parts or discrete regions of a filament with beneficial properties.

Before proceeding however, U.S. Pat. No. 3,650,884 is noted. This patent discloses a polyamide monofilament having a diameter of at least 15 mils and a microporous surface layer having a thickness of about 3 to 15 microns constituting less than 6 percent of the transverse radius of the monofilament. While the monofilament is truly a monoconstitutent monofilament (i.e., not a multi-structural filament) in that it is extruded from a single extruder containing one material, i.e., polyamide, the resultant morphology of the very thin surface layer after complete processing does differ from that of the rest of the monofilament once it has been subjected to the steaming and drawing processes set forth in the patent. This steam disoriented surface layer is, in reality, only a skin layer and constitutes less than 6 percent of the filament. In contrast, each structural profile or region created by the extrusion of the parts of a filament through the die pack necessarily constitutes more than 7 percent, and preferably more than 10 percent, of each filament where multi-structural filaments are produced using known co-extrusion techniques. Thus, it will be appreciated that the monofilament produced in U.S. Pat. No. 3,650,884 differs considerably from the multi-structural filaments produced using bicomponent processing techniques and extrusion techniques of the present invention.

Thus, the need exists for an extruded, multi-structural filament comprising only one single ingredient and having increased physical properties and performance due to the control of the shear, melt temperature, and other well known processing conditions during extrusion through a die pack.

SUMMARY OF THE INVENTION

The present invention generally relates a multi-structural filament wherein each discrete region (e.g., core, sheath, etc.) of the filament is made from the same ingredient but has a different morphology from any other different region extruded in tandem therewith after processing. Thus, the present invention preferably uses a single ingredient in two or more extruders to form a multi-structural filament having improved physical properties as compared to monofilaments and, in some instances, as compared to bicomponent filaments. It will be appreciated that some parts of the filament may have the same morphology where the processing conditions have been preset to be substantially the same. Thus, in a filament having a core-sheath cross-sectional configuration where the sheath does not completely surround the core, each portion of the sheath may have the same morphology as every other region denoted as the sheath, provided such processing is desired. Thus, as used hereinafter, each "region" shall refer to the discrete parts of the filament having the same morphology, while the term "parts" may refer to each portion of the filament individually.

More particularly, the present invention generally provides a multi-structural filament comprising a single ingredient having two or more morphologies after extrusion through a die pack wherein one discrete region of the filament comprises one morphology of the ingredient and at least another discrete region of the filament comprises another morphology of the same ingredient, and wherein each region of the filament comprises at least about 7 percent of the filament.

By the term "single ingredient," it is meant that the initial starting materials employed in the extruders are essentially chemically and physically identical. Where homopolymers and commercially available resins are directly employed, this means that the initial starting materials have the same chemical structure, and essentially the same molecular weight, molecular weight distribution, extractables, melting point, melt viscosity, and melt flow. Thus, a low density polyethylene and a high density polyethylene would not be a "single ingredient." Where blends or copolymers are employed, this means that the monomers or starting components employed are the same. However, it will be understood that monomer ratios and blend ratios in the copolymers and blends, respectively, might vary slightly, up to about 20 percent, more preferably, within about 10 percent, and even more preferably, within about 2 percent of each other, without departing from the scope of the invention with respect to the definition of "single ingredient." Thus, a copolymer having a 90:10 monomer ratio in one extruder would be considered the same "single ingredient" if the other extruder were to use the same monomers in an about 70:30 ratio, and more preferably, in an about 80:20 monomer ratio. Blend ratios would also be recognized in this way so long as the initial ingredients were the same, i.e., identical. Wider ratios of monomers or material blends could also be suitable provided they do not affect the essential nature of the invention—that is, the morphologies (i.e., the crystallinity) of the copolymers are essentially the same. In some instances, it is possible that monomer ratios or blend ratios of less than 20 percent by weight will not be suitable where the morphologies of the compositions prior to extrusion are affected by the difference in the ratios. It will be appreciated, however, that one of ordinary skill in the art will be able to readily determine what morphologies are affected without any undue experimentation, it being evident that one of ordinary skill in the art should not be able to vary the monomer ratios or blend rations in so small of an amount as to not produce any effective difference in the copolymer or blend.

Advantageously, the present invention allows for a more versatile end product, i.e., a multi-structural filament, having improved physical properties and performance characteristics. In essence, the invention provides for a toughened, more abrasion resistant composition in at least one part of the filament which is certainly compatible with any other part of the filament since it is the same ingredient. Thus, the filament improves certain physical characteristics while maintaining other characteristics found in the ingredient employed without resorting to blends of more than one ingredient in the construction of the filament. This will advantageously reduce costs required in using two or more separate and distinct ingredients.

DETAILED DESCRIPTION OF THE PREFERRED EMBODIMENTS

As noted hereinabove, the present invention is directed toward an extruded, multi-structural filament wherein each discrete region of the filament extruded is produced from essentially the same ingredient but includes a different morphology from any other discrete region of the filament extruded in tandem therewith. Such multi-structural filaments utilize well known extrusion techniques wherein two or more extruders melt and force the material resin, which is essentially the same ingredient when placed into the extruder, through a common die pack to produce multi-structural filaments wherein the parts of the filaments are of the same material but have different morphologies from each other. The change in morphology of the ingredients used to produce the filaments is believed to occur substantially due to the effects of shear and temperature as the material resin is processed through the die pack in forming the parts of the filaments. That is, by controlling the shear and melt temperature of the resin as it passes through the die pack, significant changes to the physical characteristics of the resin can occur. Consequently, a multi-structural filament comprising a single ingredient having two or more different morphologies can be produced. Such a product may be advantageously configured with a profile to benefit the end product's physical performance and characteristics, wherein each discrete region of the filament preferably includes at least about 7 percent by volume, and more preferably, at least about 10 percent by volume of the filament.

More particularly, the present invention is designed to control the shear of the material through the die pack. For example, if a core-sheath profile was desired, a die pack would be provided which would enable one or more of the extruders to force material through that portion of the die pack and along a path which would form the inner core of the filament. That material would preferably see less shear than the same material from another extruder forced through a portion of the die pack and along a path which would form the outer sheath. In light of the effects of shear and possibly other processing conditions, the present invention takes advantage of the resulting effect on the crystallinity of the material. In general, it is believed that the higher shear during extrusion of the sheath structure of the filament produces lower crystallinity (i.e., is more amorphous) in that region of the filament than the material resulting from the formation of the core which undergoes less shear and is, therefore, believed to have a higher crystallinity. Having said this, it will be understood that lower crystalline materials are generally regarded as tougher and more abrasion resistant particularly with respect to flex fatigue wear. They also are generally noted to be more flexible and have improved impact resistance and improved loop strength. In general, properties associated with the strain of the product are seen to improve. In contrast, materials having higher crystallinity are generally regarded as more chemically and thermally resistant and provide more dimensional stability than lower crystalline materials. These materials are also regarded as having higher tensile strengths, and other properties generally associated with the stress of the product are believed to be improved. Also, highly crystalline materials often tend to be less compatible with other materials.

As a result, a shear control die setup can now easily be envisioned in which the core of the filament produced has a higher crystallinity while the sheath of the filament is more amorphous, but where the material resin employed as both the core and the sheath are the same ingredient. Such a filament would essentially have good tensile strength and good impact resistance—two properties are that generally counter to each other in monofilament construction. For example, were one to attempt to produce a monofilament with greater tenacity, it is well known that impact properties would suffer. This invention essentially eliminates that difficulty, and does so using not only compatible materials, but the same material for all parts of the filament. Heretofore, there has been no way to enhance synergistically conflicting filament properties. One or the other of the properties was heretofore always compromised.

The filaments prepared in accordance with the present invention have exhibited significantly improved mechanical properties. These properties include increased wear resistance and flex fatigue resistance, toughness, increased tensile, loop and knot strengths, and increased impact resistance, depending upon the application employed.

The filaments of the present invention are not limited to core-sheath configurations. Essentially any multi-structural relationship which can be envisioned may be employed. As noted above, these filaments can best characterized according to the manner in which the discrete regions of the filament are arranged in relation to each other. For example, the regions may have a side-by-side arrangement, or an outer-inner arrangement. In the outer-inner arrangement, one of the regions is located substantially toward the periphery of the filament, in what may be referred to as the sheath or the outer region, while the other region is located at the "core" of the filament. Other examples of outer-inner arrangements include an islands-in-the-stream arrangement, where the inner region comprises several smaller sized parts surrounded by the outer region sheath. Examples of outer-inner arrangements of three regions in a filament include a sheath-mantle-core arrangement and an islands-in-the-stream arrangement, among others. The outer-inner arrangement of the filament can be symmetrical or asymmetrical.

The filaments of the present invention may have any peripheral configuration known in the art. These configurations include a round, polygon or flattened shape, with smooth, serrated, or irregular edges. It may be multi-lobal, such as tri-lobal, tetra-lobal, penta-lobal, hexa-lobal, and the like. There is no requirement that the outer region completely encompass or surround the inner region. In instances where dye is used to differentiate the regions by color, it will be understood that the filament may be "striped" with the outer region extending along the edges of the inner region of the monofilament parallel to the longitudinal axis.

The invention is preferably devoid of any other fillers or additives. As discussed in the background, most prior art multi-structural filaments, i.e., those filaments having core-sheath or other cross-sectional configurations, have been bi-component filaments, meaning they were constructed by means of two separate extruders, with two different ingredients. In some instances, this has meant that one extruder employed a common material such as PET, while the other extruder employed that same material plus an additive or filler which improved or otherwise modified the material (e.g., PET) in such a manner as to improve one or more physical properties of the composition. Accordingly, upon extrusion and production of the bi-component filament, the improved property affected by the additive or filler would provide beneficial results to the filament.

In contrast, there are no such additives or fillers in the present invention. While some additives, such as dyes and the like, may be added to the compositions, these additives do not affect the essential nature of the invention, meaning they do not significantly affect the morphologies of the compositions.

It will be appreciated, however, that additives and fillers can be added in relatively the same amounts to all extruders using the same materials and still be considered a "single ingredient" according to the terms of the present invention. Thus, adding a hydrolytic stabilizer to PET is acceptable if it is also added in relatively (i.e., within from about 0.001 to about 5 percent depending upon the additive and the amount employed) the same amount to both (or all) extruders so as not to substantially provide a difference in the morphologies between the compositions or blends to be extruded. Thus, where an additive is appreciably added in an amount of about 0.5 grams, that same additive should be added in essentially the same amount, with only minor standard deviations. If, on the other hand, the additive is added in amounts on the order to 10,000 kilograms, and constitutes, say for example, about 40 percent of the composition employed, it will be appreciated that the standard of deviation will be much greater and, potentially could reach about 5 percent.

Any known material suitable for extrusion into filaments can be used in the present invention. Traditional ingredients have included, but are not limited to polyolefins, as exemplified by polyethylene (PE) or polypropylene (PP); polyesters, as exemplified by polyethylene terephthalate (PET); polyamides, as exemplified by nylon homopolymers (e.g., nylon 6 or nylon 6,6) and copolymers (e.g., nylon 6,6,6); and specialty polymers such as high temperature or high performance thermoplastics, as exemplified by polyphenylene sulfide (PPS) and polyether ether ketone (PEEK). Such ingredients have been traditionally used in extruding monofilaments and bicomponent fibers.

With respect to fiber toughness and abrasion resistance, the filaments' properties of these materials improve roughly across the series: high temperature thermoplastics (PPS) →polyester (PET)→polyolefin (PE or PP)→polyamide (nylon)→polyamide copolymers. On the other hand, dimensional and thermal stability increases roughly in the opposite direction, that is, polyamide (nylon)→polyester (PET) →high temperature thermoplastics (PPS). Means of improving the tenacity and toughness of monofilaments while maintaining dimensional stability have long been the subject of patented inventions such as disclosed in U.S. Pat. Nos. 4,748,077, 4,801,492, 5,424,125, 5,456,973, and 5,667,890, all owned by the assignee of record. The present invention seeks to improve these same properties using the same material throughout a multi-structural filament.

The type(s) of material employed to produce the filaments depends greatly on the application desired. More example, polyamides are at a disadvantage in high moisture environments where dimensional stability is required. On the other hand, high temperature thermoplastics do not provide the toughness and impact resistance necessary for use as weed trimmer lines and the like. Nevertheless, although this disclosure now proceeds to discuss the production of multi-structural filaments for various preferred applications, the present invention should not necessarily be seen as limited thereto, the scope and spirit of the present invention being determined by the claims themselves and not necessarily any one particular embodiment. Moreover, it will be appreciated that while certain materials are referred to as being desired for certain applications, other materials known in the art may also be suitable for those applications, and the present invention is in no way necessarily limited to those materials specified.

With respect to high temperature and high performance thermoplastic polymers, there are a number of thermoplastic materials capable of being used in constructing filaments of the present invention therefrom. Among the more well utilized materials from this category of materials includes, but not necessarily limited to, polyphenylene sulfide (PPS), polyether ether ketone (PEEK) and polycyclohexanedimethyl terephthalate/isophthalate (PCTA).

PPS is well known in the art as a material for monofilaments and filaments used in a number of applications, including as filaments woven into industrial and other technical fabrics. Polyphenylene sulfide, the simplest member of the polyarylene sulfide family, has outstanding chemical and thermal resistance. PPS is insoluble in all common solvents below 392° F. (200° C.) and is inert to steam, strong bases, fuels and acids. PPS is further inherently flame resistant. The aforementioned characteristics, coupled with minimal moisture absorption and a very low coefficient of linear thermal expansion, make monofilaments thereof suitable for use in many high temperature applications where dimensional stability in harsh chemical environments are extremely important. Unfortunately, the usefulness of PPS in some applications is limited due to the relatively high cost of the material and its relatively poor mechanical properties. In particular, PPS is very brittle in monofilament form. While it is desired to make fabrics prepared from filaments of PPS to be used in high temperature applications, such as in the dryer sections of papermaking machines, low tensile strengths (about one-half that of PET), as well as low loop and knot strengths (also about half that of PET) have resulted in problems over time during weaving or use of the fabrics.

Consequently, only when improvements in these physical properties of PPS were made, did PPS become satisfactory for use as paper machine dryer fabric. However, heretofore, those improvements have come in the form of resin mixtures or blends with compatible polymers or polymer additives capable of toughening the composition without significantly comprising the heat and chemical resistance properties of PPS. For example, U.S. Pat. No. 5,424,125 discloses the construction of a monofilament comprising a blend of PPS and at least one other polymer selected from PET, a high temperature polyester resin (such as PCT or PCTA), or polyphenylene oxide (PPO). Similarly, U.S. Pat. No. 4,610,916 discloses the construction of a monofilament comprising a blend of PPS and a copolymer of an olefin and a halogenated monomer. Yet, problems with cost and processability remain. The present invention seeks to improve the physical properties of the filament including increasing tenacity, loop tenacity and loop impact strength without sacrificing any heat or chemical resistance, and eliminating processing concerns. Because of the harsh chemical and thermal environment in which these fabrics are used, fabrics of PPS have extended life and better overall performance than fabrics composed of monofilaments of conventional materials such as polyethylene terephthalate (PET) and polyamides.

Another suitable high performance thermoplastic is polyetheretherketone (PEEK). PEEK is known as a material which has relatively good dimensional stability, and exhibits excellent chemical and moisture resistance. It is insolvent in many but not all of the same solvents as PPS, and does not suffer nearly as much in terms of poor mechanical properties as PPS. Given its relatively balanced properties, PEEK has been used in a variety of applications, such as electrical and electronic parts, military equipment, automotive parts, wires and cables, as well as advanced structural composites for aircraft. PEEK, however, is lesser known in monofilament applications, presumably due to its cost, and other possible processing conditions required for its preparation.

With respect to polyesters, monofilaments have also long been made therefrom. Conventional polyesters such as polyethylene terephthalate (PET) having been used to make monofilaments for many applications. One of its useful applications is as a forming fabric in paper making machines. Other polyesters include copolyesters containing at least 50 mole percent of ethylene terephthalate units. Suitable copolymerization units in said copolyester include isophthalic acids, isophthalic acids with a metal sulfonate group, bisphenols, neopentyl glycols, and 1,6-cyclohexanediols. Other polyesters in addition to PET useful in the present invention include, but are not limited to, polytrimethylene terephthalate (PTT), polypropylene terephthalate (PPT), polybutylene terephthalate (PBT), polyethylene naphthalate (PEN) and the like.

Polyesters of the type suitable for use in the present invention are generally commercially available. In some instances, it may be preferred that the polyester contain about 0.007 percent by weight of water. Preferably, the polyester material has an intrinsic viscosity (IV) of from about 0.60 to about 0.99, more preferably, from about 0.85 to about 0.99, and even more preferably, from about 0.90 to about 0.95.

PET and other polyesters generally have a good balance of properties, falling between PPS and polyamides in terms of both abrasion resistance and dimensional stability.

With respect to polyamides, monofilaments have also long been made therefrom. Preferred polyamides are nylons and nylon copolymers. Nylons include, but are not limited to nylon 6, nylon 6/6, nylon 6/9, nylon 6/10, nylon 6/12, and nylon 6/36. Nylon copolymers include, but are not limited to, nylon 6/66, nylon 66/6, nylon 6/612, and nylon 6/636. Again, production of these materials are known in the art and typically are commercially available or their methods of manufacture are well known in the art.

Nylons are well known for their toughness and abrasion resistance. However, as noted hereinabove, they lack in dimensional stability. Nevertheless, increases in toughness and wear abrasion resistance, including impact strength, are always being sought. That is, nylon filaments having increase abrasion resistance and toughness as compared to other nylon monofilaments are seen as providing improved fishline or weed trimmer cutting line, as well as improved industrial filtration fabrics, hook and loop fasteners, bristle monofilaments, and sewing thread.

Polyolefins may also be utilized in the present invention. Preferred polyolefins include polyethylene and polypropylene, although essentially any polyolefin capable of being made into a filament via the co-extrusion process of the present invention may be employed.

In order to demonstrate practice of the present invention, single ingredient, multi-structural filaments were prepared according to the concepts of the present invention. The mechanical properties of these filaments were then tested for improvement over the current technological filaments employed in a variety of applications.

In particular, in a preferred embodiment, various filaments containing the single ingredient polyphenylene sulfide (PPS) available from Philips under the trademark RYTON GRO6) were prepared by co-extruding the same PPS material from two separate extruders working in tandem through a die pack having two different flow paths for the production of a filament having a core-sheath cross sectional configuration. The filaments contained about 80% core material and about 20% sheath material. The melt flow path in the die pack of the material to comprise the sheath was constructed in a manner that provided greater shear to the material being extruded therethrough as compared to the melt flow path of the (same) material to comprise the core. Other than the different flow paths, the materials to be constructed in the filaments were prepared and processed in essentially the same manner. For PPS, this meant that the filaments were prepared in accordance with specifications typically found for the use in the manufacture of technical fabrics, particularly fabrics used in the dryer sections of paper making machines. Such processing conditions include extrusion temperatures between about 290° C. and about 320° C. in the melt extruder. The process included a single stage draw in an oven at 96° C. where the draw ratio was about 3.9/1 and then it was relaxed in an annealing oven at 149° C. to about 11.4%. Thus the effective draw 3.45/1.

Once the multi-structural filaments were made, a differential scanning calorimeter (DSC) was used to determine the crystallinity of the filaments. Results of the DSC analysis as conducted under ASTM Method D3417-97 are shown in Table I below for not only the above prepared PPS filaments, but also for other tested filaments as described below.

TABLE I

Crystallinity Comparisons of Core-Sheath Components from Tested Filaments

| Sample | Heat of Fusion/Core | Heat of Fusion/Sheath |
|---|---|---|
| PPS | 38.895 J/g | 30.557 J/g |
| Nylon 6/66 | 36.159 J/g | 27.021 J/g |

It will be appreciated that the heat of fusion of the sheath is substantially lower than that of the core. This lower heat of fusion in the sheath indicates a change in enthalpy due to the difference in the morphology. This change in morphology indicates a lower degree of crystallinity in the sheath. This, in turns, provides improvement in certain mechanical characteristics of the polymeric filament.

Various mechanical properties of the filaments were tested based upon the general application for which the filaments were developed. For PPS, the application is a dryer fabric. To that end, a offset reed tensile impact test and a loop impact strength test were performed on these filaments as well as control monofilaments comprising the same material, namely PPS. The first control filament included not only PPS, but also a toughening agent, namely an ethylene-tetrafluoroethylene copolymer (ETFE) commercially available from DuPont under the tradename TEFZEL 210. The second control filament is a 100% PPS monofilament produced in a manner which is believed to optimize its mechanical properties. The monofilament was produced using processing conditions similar to those of the present invention as set forth hereinabove.

The offset reed tensile impact test uses ASTM Test Method No. D1822-83, but modifies it to measure energy to fracture or rupture of the filament along its axis. The test is conducted by tying a filament to the pendulum and a holding clamp or device. The filament is threaded through a textile loom reed such that, as the weighted pendulum falls, the filament is placed under tension against the textile loom reed. The number of cycles to break may then be recorded.

Similarly, the loop impact strength test employs essentially the same apparatus, but this test may be conducted in looped form wherein two filaments are looped together between a holding device and a pendulum with a predetermined weight. As the pendulum falls, the filament is placed under tension and may eventually break after so many cycles or so much force is applied.

The results of these tests and other well known mechanical properties are set forth in Table II.

TABLE II

PPS Mechanical Properties

| Sample | Control 1 | Control 2 | Filament 1 |
|---|---|---|---|
| Diameter (mm) | 0.6 | 0.6 | 0.6 |
| Tenacity (gpd) | 2.8 | 3.95 | 3.1 |
| Elongation at break (%) | 37 | 36 | 49.5 |
| Load at 10% elongation (gpd) | 1.06 | 1.5 | 1.07 |
| Loop Tenacity (gpd) | 2.8 | 4.6 | 3.5 |
| Shrinkage at 400F (%) | 4 | 1.2 | 2.5 |
| Modulus (gpd) | 45.6 | N/A | 41.8 |

TABLE II-continued

PPS Mechanical Properties

| Sample | Control 1 | Control 2 | Filament 1 |
|---|---|---|---|
| Offset Reed Tensile Impact (ft-lbs/in) | 157 | 155 | No break |
| Loop Impact strength (ft-lbs/in) | 271 | 297 | No break |

It should be clear that the new filament of the present invention showed significant improvement in the notched (offest reed) and unnotched (loop impact) strength and toughness of the filament as compared to the controls, particularly when compared to Control monofilament 1. While tenacities were lower in the filament of the present invention as compared to Control monofilament 2, the offset reed tensile impact properties and loop impact strength significantly improved. In particular, the filaments of the present invention did not break in these tests, while each of the controls did. Thus, it should be evident that at least some of the mechanical properties of the filament, and particularly, those most important to the application for which the filament is to be employed, have improved over monofilaments of the same material. Properties of Filament 1 show an overall improvement in both static and dynamic mechanical properties. This makes this particular filament suitable for use is the dryer sections of papermaking machines.

While not bound to theory, it is believed that the differentiated sheath by its morphology provided a cladding layer that deflected notch failure in impact and stopped propagation of the fracture. Weaving of more complex, mechanically demanding fabric designs or three-dimensional structures requires a more balanced PPS monofilament. This filament provides this balance of properties.

In another embodiment, two more filaments were again prepared as essentially described above, but this time, nylon 6/66 was utilized as the single ingredient. Moreover, the filaments were designed to employ a core-tips cross sectional configuration wherein about 70% of the cross sectional structure constituted the core and about 30% of the cross sectional structure constituted the "tips" for a cutting line, while about 80% of the cross sectional structure constituted the core and about 20% the sheath in the production of a fishline. Both the core and the tips (or sheath) were extruded from a nylon 6/66 copolymer using about 85 percent nylon 6 and 15 percent nylon 66. The filament was extruded and prepared according to conventional trimmer line processing techniques with respect to quenching, drawing and relaxing the filament.

Such a filament may be useful in a variety of applications, including as a fishline or a weed trimmer cutting line. Again, as shown in Table I, the heat of fusion of the core was significantly higher than the heat of fusion for the sheath (i.e., the tips), thereby suggesting that the tips have a significant change in its morphology and has lower crystallinity than the core. In turn, this would make the tips tougher and more wear/abrasion resistant.

To determine whether any improvement in the filament can be seen, various physical tests were conducted with the nylon 6/66 filament prepared according to the concepts of the present invention and a control monofilament containing nylon 6/66. The results of the various tests conducted for fishline and cutting line are shown in Table III below.

Again, the mophologically differientated tips add a toughen exterior which is independent of mechanical deflection of impact and shows flex fatigue dissipation. This "sheath" layer protects the core from propagation of fracture initiated at the filaments surface by cuts or nicks.

TABLE III

Mechanical Properties Test Results for Nylon 6/66 Filaments

| Fishline | Control | Filament 2 |
|---|---|---|
| Abrasion Resist (Cycles to fall) | 1,456 | 26,592 |
| 200 Cycles Abrasion (Tensile) | 21.26 | 23.15 |
| 400 Cycles Abrasion (Tensile) | 19.72 | 22.95 |
| Knot Strength (Tensile) | 14.31 | 18.83 |
| Palamar Knot (Tensile) | 18.064 | 19.78 |
| **Cutting Line** | **Control** | **Filament 3** |
| Weight Loss (grams) | .2273 | .0607 |
| Inches Lost | 1.5 | .3275 |
| Sq. Ft./in. cut per line worn | 482 | 2,268 |

Based upon a review of the results, it is apparent that the filaments of the present invention again improve in both the static and dynamic properties. The sheath layer acts to strengthen the fishline and cutting line properties much like a composite filament, but this filament is not. They layers contain the same ingredient.

It will be appreciated that the present invention has improved the mechanical properties of filaments suitable for use in cutting line, fishline and dryer fabrics for papermaking machines. Other application for which the filaments or the present invention is believed to be particularly suited include, but are not limited to PET forming fabrics and nylon forming fabrics and press felts for paper making machines, nylon hook and loop fabric, nylon sewing thread, nylon bristles, and various industrial filaments using for filtration and the like.

Although the present invention has been described in the above examples with reference to particular means, materials and embodiments, it would be obvious to persons skilled in the art that various changes and modifications may be made, which fall within the scope claimed for the invention as set out in the appended claims. The invention is therefore not limited to the particulars disclosed and extends to all equivalents within the scope of the claims.

What is claimed is:

1. A multistructural filament comprising a single ingredient having one melting point and two or more morphologies after extrusion through a die pack wherein one discrete region of the filament comprises one morphology of the ingredient and at least another discrete region of the filament comprises another morphology of the single ingredient, and wherein each region of the filament comprises at least about 7 percent by volume of the filament.

2. The multi-structural filament according to claim 1, wherein the single ingredient is selected from the group consisting of polyamides, polyesters, polyolefins and high performance thermoplastics.

3. The multi-structural filament according to claim 1, wherein the single ingredient is a blend of materials.

4. The multi-structural filament according to claim 1, wherein the single ingredient is a copolymer.

5. The multi-structural filament according to claim 1, wherein the single ingredient is polyphenylene sulfide.

6. The multi-structural filament according to claim 1, wherein the single ingredient is a nylon copolymer.

7. The multi-structural filament according to claim 6, wherein the single ingredient is nylon 6/66.

8. The multi-structural filament according to claim 1, further comprising a core-sheath configuration.

9. The multi-structural filament according to claim 8, wherein the core has a higher crystallinity than the sheath.

10. The multi-structural filament according to claim 1, further comprising a core-tips configuration.

11. The multi-structural filament according to claim 10, wherein the core has a higher crystallinity than the tips.

12. The multi-structural filament according to claim 1, wherein each region of the filament comprises at least 10 percent by volume of the filament.

13. The multi-structural filament according to claim 1, wherein the filament has increased toughness and abrasion resistance as compared to monofilaments prepared from the single ingredient.

* * * * *